US007728831B2

(12) United States Patent
Yaita et al.

(10) Patent No.: US 7,728,831 B2
(45) Date of Patent: Jun. 1, 2010

(54) SEMICONDUCTOR DEVICE, ELECTRO-OPTICAL DEVICE, AND ELECTRONIC INSTRUMENT

(75) Inventors: Kensuke Yaita, Nagano-ken (JP); Masahiko Tsuchiya, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 206 days.

(21) Appl. No.: 12/081,778

(22) Filed: Apr. 21, 2008

(65) Prior Publication Data

US 2009/0251064 A1 Oct. 8, 2009

(30) Foreign Application Priority Data

Apr. 20, 2007 (JP) ..... 2007-111353
Apr. 16, 2008 (JP) ..... 2008-106905

(51) Int. Cl.
*G09G 5/00* (2006.01)
*G09G 3/30* (2006.01)

(52) U.S. Cl. ..... 345/212; 345/80

(58) Field of Classification Search ..... 345/76, 345/77, 80, 204, 212, 214, 697
See application file for complete search history.

(56) References Cited

U.S. PATENT DOCUMENTS 6,366,065 B1 4/2002 Morita
6,384,806 B1 * 5/2002 Matsueda et al. ..... 345/89
7,623,122 B2 * 11/2009 Fujita ..... 345/204

FOREIGN PATENT DOCUMENTS

JP A 2001-188615 7/2001

* cited by examiner

*Primary Examiner*—Thuy V Tran
(74) *Attorney, Agent, or Firm*—Oliff & Berridge, PLC

(57) ABSTRACT

A semiconductor device includes a source circuit and a control circuit. The source circuit includes a plurality of operational amplifiers, a plurality of transmission gates, one end of each of the transmission gates being connected to a corresponding source line, and a buffer circuit that outputs a switch control signal. When the number of transmission gates that are turned ON/OFF using the buffer circuit is referred to as n, a gate width and a gate length of a MOSFET of each of the transmission gates are respectively referred to as Wb and Lb, a gate width and a gate length of a MOSFET of the buffer circuit are respectively referred to as Wa and La, and K indicates a constant, the relationship $n \times Wb \times Lb \geqq K \times (Wa/La)$ is satisfied.

17 Claims, 12 Drawing Sheets

FIG. 9A SAMPLING PERIOD
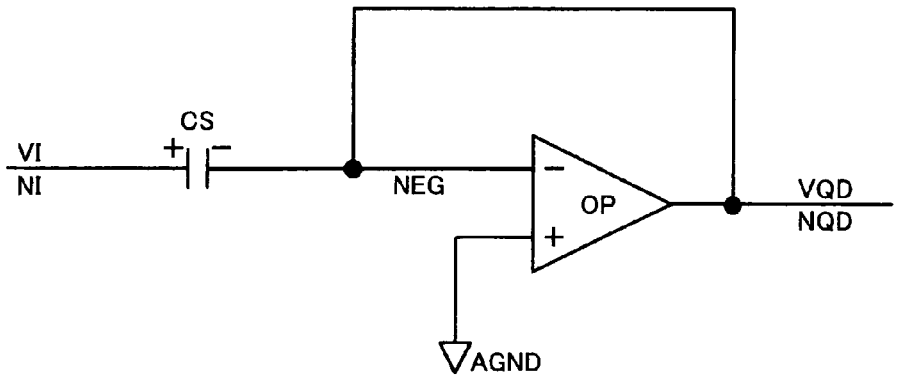
FIG. 9B HOLDING PERIOD
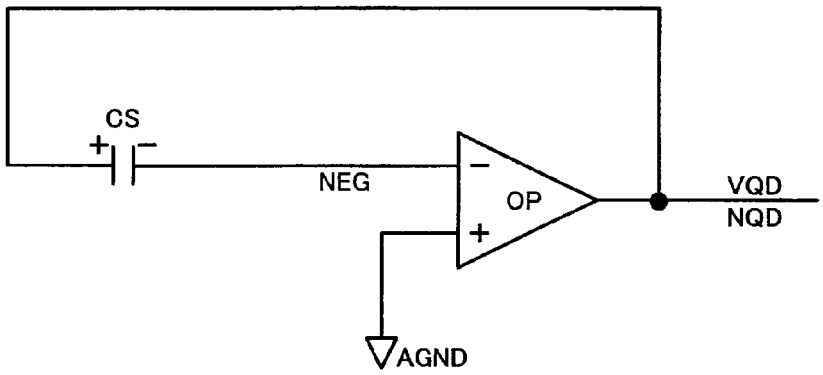

SEMICONDUCTOR DEVICE, ELECTRO-OPTICAL DEVICE, AND ELECTRONIC INSTRUMENT

Japanese Patent Application No. 2007-111353 filed on Apr. 20, 2007 and Japanese Patent Application No. 2008-106905 filed on Apr. 16, 2008, are hereby incorporated by reference in their entirety.

BACKGROUND OF THE INVENTION

The present invention relates to a semiconductor device, an electro-optical device, an electronic instrument, and the like.

As an electro-optical panel used for electronic instruments (e.g., portable telephone, television, and projector (projection-type display device)), a simple matrix type liquid crystal panel and an active matrix type liquid crystal panel using a switch element (e.g., thin film transistor) have been known. In recent years, an electro-optical panel using a light-emitting element such as an electroluminescence (EL) element has attracted attention.

As a related-art example of a display driver that drives such an electro-optical panel, technology disclosed in JP-A-2001-188615 is known, for example. In this related-art example, an electro-optical panel is driven while selectively performing operational amplifier drive that uses an operational amplifier with high drive capability and DAC drive that can reduce a variation in output voltage between the adjacent source lines within a 1H period.

According to this related-art example, the electro-optical panel serves as an antenna so that noise generated by a display driver produces EMI noise, whereby the reception sensitivity of a portable telephone decreases, for example.

SUMMARY

According to one aspect of to the invention, there is provided a semiconductor device that drives an electro-optical panel, the semiconductor device comprising:

a source circuit that drives a plurality of source lines of the electro-optical panel; and a control circuit that controls the source circuit, the source circuit including:

a plurality of operational amplifiers that respectively drive the plurality of source lines;

a plurality of transmission gates provided corresponding to the plurality of operational amplifiers, one end of each of the plurality of transmission gates being connected to a corresponding source line among the plurality of source lines; and a buffer circuit that outputs a switch control signal that causes the plurality of transmission gates to be turned ON/OFF; and when the number of transmission gates that are turned ON/OFF using the buffer circuit is referred to as n, a gate width and a gate length of a MOSFET of each of the plurality of transmission gates are respectively referred to as Wb and Lb, a gate width and a gate length of a MOSFET of the buffer circuit are respectively referred to as Wa and La, and K indicates a constant, the relationship $n \times Wb \times Lb \geqq K \times (Wa/La)$ being satisfied.

According to another aspect of the invention, there is provided a semiconductor device comprising:

a plurality of transmission gates; and a buffer circuit that outputs a switch control signal that causes the plurality of transmission gates to be turned ON/OFF, when the number of transmission gates that are turned ON/OFF using the buffer circuit is referred to as n, a gate width and a gate length of a MOSFET of each of the plurality of transmission gates are respectively referred to as Wb and Lb, a gate width and a gate length of a MOSFET of the buffer circuit are respectively referred to as Wa and La, and K indicates a constant, the relationship $n \times Wb \times Lb \geqq K \times (Wa/La)$ being satisfied.

According to another aspect of the invention, there is provided an electro-optical device comprising one of the above semiconductor devices.

According to another aspect of the invention, there is provided an electronic instrument comprising the above electro-optical device.

BRIEF DESCRIPTION OF THE SEVERAL VIEWS OF THE DRAWING

FIGS. 9A and 9B are views illustrative of the operation of a flip-around sample/hold circuit.

DETAILED DESCRIPTION OF THE EMBODIMENT

Figure 1:
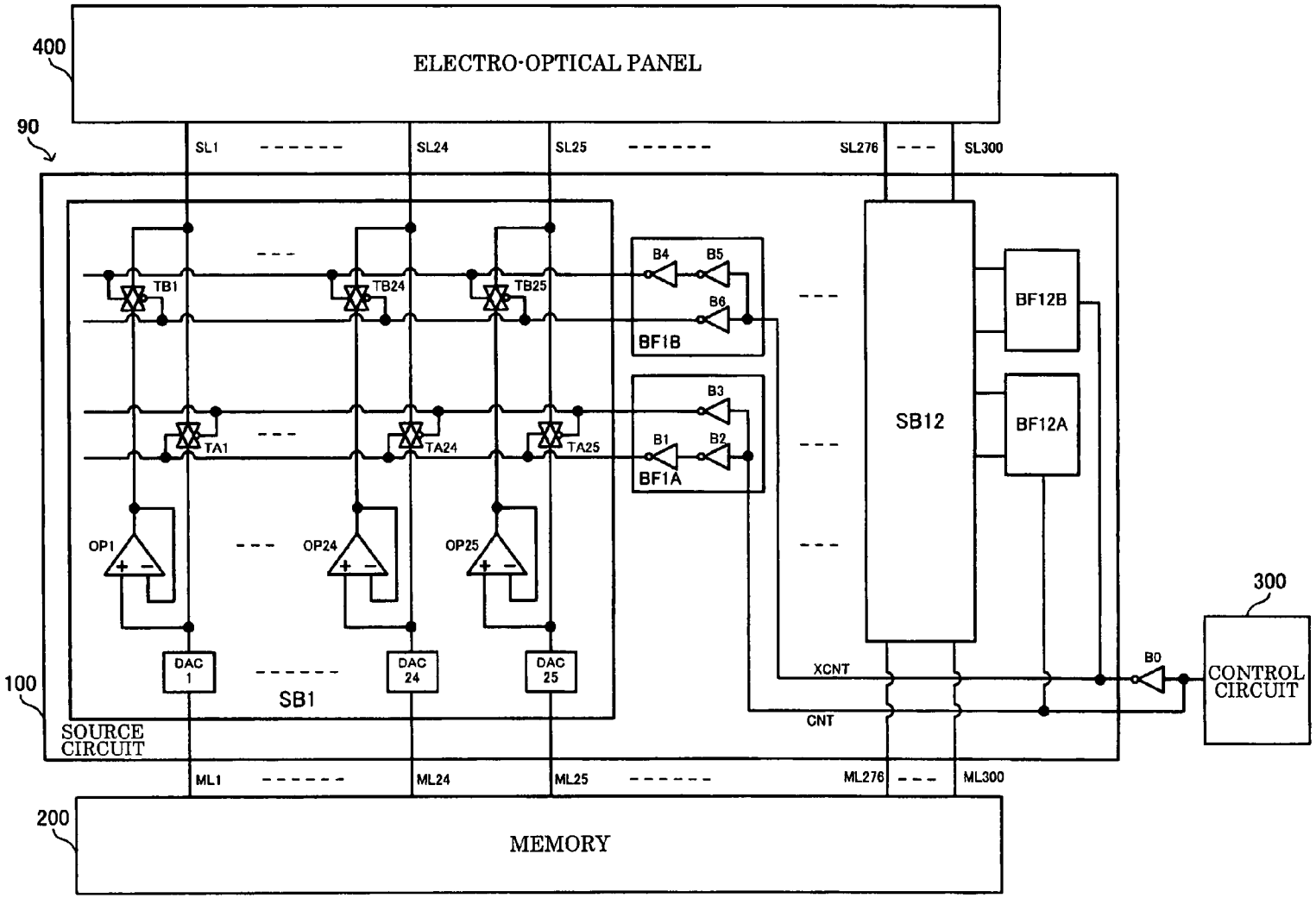
FIG. 1 shows a configuration example of a semiconductor device according to one embodiment of the invention.

Several aspects of the invention may provide a semiconductor device, an electro-optical device, and an electronic instrument that may reduce EMI noise.

According to one embodiment of the invention, there is provided a semiconductor device that drives an electro-optical panel, the semiconductor device comprising:

a source circuit that drives a plurality of source lines of the electro-optical panel; and a control circuit that controls the source circuit, the source circuit including:

a plurality of operational amplifiers that respectively drive the plurality of source lines;

a plurality of transmission gates provided corresponding to the plurality of operational amplifiers, one end of each of the plurality of transmission gates being connected to a corresponding source line among the plurality of source lines; and a buffer circuit that outputs a switch control signal that causes the plurality of transmission gates to be turned ON/OFF; and when the number of transmission gates that are turned ON/OFF using the buffer circuit is referred to as n, a gate width and a gate length of a MOSFET of each of the plurality of transmission gates are respectively referred to as Wb and Lb, a gate width and a gate length of a MOSFET of the buffer circuit are respectively referred to as Wa and La, and K indicates a constant, the relationship $n \times Wb \times Lb \geqq K \times (Wa/La)$ being satisfied.

According to this embodiment, the source circuit includes the operational amplifiers, the transmission gates, and the buffer circuit. The buffer circuit outputs the switch control signal that causes the transmission gates to be turned ON/OFF. According to this embodiment, $n \times Wb \times Lb \geqq K \times (Wa/La)$ is satisfied with regard to the number of transmission gates, the gate width Wb and the gate length Lb of the MOSFET of the transmission gate, and the gate width Wa and the gate length La of the MOSFET of the buffer circuit. High-frequency noise generated at the rising edge or the falling edge of the switch control signal can be reduced by driving the n transmission gates using the buffer circuit that satisfies the above relationship. Therefore, a reduction in EMI noise and the like can be implemented.

In the semiconductor device according to this embodiment, the source circuit may include:

a plurality of source blocks; and a plurality of repeater circuits respectively provided corresponding to the plurality of source blocks;

the plurality of operational amplifiers and the plurality of transmission gates may be provided in each of the plurality of source blocks;

the buffer circuit may be provided in each of the plurality of repeater circuits; and the buffer circuit provided in each of the plurality of repeater circuits may output the switch control signal that causes the plurality of transmission gates provided in a corresponding source block among the plurality of source blocks to be turned ON/OFF.

According to this configuration, an efficient layout of the semiconductor device and the like can be implemented by dividing the source circuit into a plurality of source blocks and providing the repeater circuits corresponding to the source blocks. Moreover, a reduction in EMI noise can be implemented by providing the buffer circuit in each repeater circuit and satisfying $n \times Wb \times Lb \geqq K \times (Wa/La)$. This makes it possible to implement an efficient layout of the semiconductor device while implementing a reduction in EMI noise and the like.

In the semiconductor device according to this embodiment, each of the plurality of source blocks may include n source line driver circuits;

an operational amplifier among the plurality of operational amplifiers and a transmission gate among the plurality of transmission gates may be provided in a corresponding source line driver circuit among the n source line driver circuits; and the buffer circuit provided in each of the plurality of repeater circuits may output the switch control signal that causes the plurality of transmission gates provided in the n source line driver circuits to be turned ON/OFF.

According to this configuration, an efficient layout of the semiconductor device and the like can be implemented by providing the n source line driver circuits in each source block and providing the operational amplifier and the transmission gate in each source line driver circuit. Moreover, a reduction in EMI noise can be implemented by providing the buffer circuit in each repeater circuit and satisfying $n \times Wb \times Lb \geqq K \times (Wa/La)$.

In the semiconductor device according to this embodiment, each of the plurality of source blocks may include a D/A conversion circuit that receives image data and D/A-converts the image data; and the D/A conversion circuit may be shared by the n source line driver circuits.

According to this configuration, since it suffices to provide one D/A conversion circuit corresponding to the n source driver circuits, the area occupied by the D/A conversion circuit can be reduced. Therefore, the area of the semiconductor device can be reduced.

In the semiconductor device according to this embodiment, the D/A conversion circuit may receive subpixel image data as the image data, and may output voltages corresponding to the subpixel image data by time division in each of first to nth sampling periods; and each of the n source line driver circuits may sample the voltages output from the D/A conversion circuit in each of the first to nth sampling periods.

According to this configuration, the n source line driver circuits can appropriately sample the voltages output from the D/A conversion circuit by time division in the first to nth sampling periods.

In the semiconductor device according to this embodiment, each of the n source line driver circuits may include a flip-around sample/hold circuit that includes an operational amplifier among the plurality of operational amplifiers.

Since the source line driver circuit can be provided with a sample/hold function and an offset-free state can be implemented by utilizing the flip-around sample/hold circuit, a highly accurate voltage with a small variation can be supplied to the source line.

In the semiconductor device according to this embodiment, the other end of each of the plurality of transmission gates may be connected to an output terminal of the operational amplifier of the corresponding flip-around sample/hold circuit.

This prevents a situation in which an unstable voltage output from the operational amplifier in the sampling period of the flip-around sample/hold circuit is transmitted to the source line.

In the semiconductor device according to this embodiment, the flip-around sample/hold circuit may include:

the operational amplifier, a non-inverting input terminal of the operational amplifier being set at an analog reference power supply voltage;

a feedback transmission gate provided between an output terminal and an inverting input terminal of the operational amplifier;

a flip-around transmission gate provided between the output terminal of the operational amplifier and a first node;

a sampling capacitor provided between the inverting input terminal of the operational amplifier and the first node; and a sampling transmission gate provided between an input node of the flip-around sample/hold circuit and the first node.

According to this configuration, the output voltage corresponding to a charge stored in the sampling capacitor can be output in the hold period by sampling the voltage input to the input node using the sampling capacitor in the sampling period and performing the flip-around operation of the sampling capacitor.

In the semiconductor device according to this embodiment, one end of each of the plurality of transmission gates may be connected to a corresponding source line among the plurality of source lines, and the other end of each of the plurality of transmission gates may be connected to an input terminal of a corresponding operational amplifier among the plurality of operational amplifiers.

This implements DAC drive so that an improvement in display quality and the like can be implemented.

In the semiconductor device according to this embodiment, one end of each of the plurality of transmission gates may be connected to a corresponding source line among the plurality of source lines, and a common potential may be supplied to the other end of each of the plurality of transmission gates.

This makes it possible to reduce power consumption while implementing a reduction in EMI noise and the like.

According to another embodiment of the invention, there is provided a semiconductor device comprising:

a plurality of transmission gates; and a buffer circuit that outputs a switch control signal that causes the plurality of transmission gates to be turned ON/OFF, when the number of transmission gates that are turned ON/OFF using the buffer circuit is referred to as n, a gate width and a gate length of a MOSFET of each of the plurality of transmission gates are respectively referred to as Wb and Lb, a gate width and a gate length of a MOSFET of the buffer circuit are respectively referred to as Wa and La, and K indicates a constant, the relationship $n \times Wb \times Lb \geqq K \times (Wa/La)$ being satisfied.

According to this embodiment, $n \times Wb \times Lb \geqq K \times (Wa/La)$ is satisfied with regard to the number of transmission gates, the gate width Wb and the gate length Lb of the MOSFET of the transmission gate, and the gate width Wa and the gate length La of the MOSFET of the buffer circuit. High-frequency noise generated at the rising edge or the falling edge of the switch control signal can be reduced by driving the n transmission gates using the buffer circuit that satisfies the above relationship. Therefore, a reduction in EMI noise and the like can be implemented.

In the semiconductor device according to this embodiment, the relationship $n \times Wb \times Lb \geqq 12 \times (Wa/La)$ may be satisfied.

According to another embodiment of the invention, there is provided an electro-optical device comprising one of the above semiconductor devices.

According to another embodiment of the invention, there is provided an electronic instrument comprising the above electro-optical device.

Preferred embodiments of the invention are described in detail below. Note that the following embodiments do not in any way limit the scope of the invention defined by the claims laid out herein. Note that all elements of the following embodiments should not necessarily be taken as essential requirements for the invention.

1. Semiconductor Device

FIG. 1 shows a configuration example of a semiconductor device 90 (integrated circuit device, LCD driver, or display driver) according to one embodiment of the invention. The semiconductor device 90 drives an electro-optical panel 400 such as an LCD panel. The semiconductor device 90 includes a source circuit 100 and a control circuit 300. When the semiconductor device 90 includes a memory, the semiconductor device 90 may include a memory 200 (data output circuit).

The electro-optical panel 400 includes a plurality of source lines (data lines), a plurality of gate lines (scan lines), and a plurality of pixels specified by the source lines and the gate lines. A display operation is implemented by changing the optical properties of an electro-optical element (liquid crystal element, EL element, or the like in a narrow sense) in each pixel area. The electro-optical panel (display panel in a narrow sense) may be formed using an active matrix type panel using a switch element such as a TFT or a TFD. The electro-optical panel may be a panel other than the active matrix type panel, or may be a panel using a light-emitting element such as an organic electroluminescence (EL) element or an inorganic EL element.

The source circuit 100 (data driver or data line driver circuit) is a circuit that drives a plurality of source lines (data lines) SL1 to SL300 of the electro-optical panel 400. The source circuit 100 supplies a source signal (data signal) to the source lines SL1 to SL300. For example, the source circuit 100 receives image data (grayscale data or display data) from the memory 200. The source circuit 100 receives a plurality of grayscale voltages from a grayscale voltage generation circuit (gamma correction circuit) (not shown), selects voltages (data voltages) corresponding to the image data (grayscale data) from the grayscale voltages, and outputs the selected voltage to the source lines SL1 to SL300 of the electro-optical panel 400, for example. The semiconductor device according to this embodiment may be mounted on the electro-optical panel 400 using a COG method or a TAB method. Alternatively, transistors of the source circuit 100 or the like may be formed using TFTs, and the source circuit 100 or the like may be integrally formed with pixel TFTs (switching elements) of the electro-optical panel 400.

The memory 200 (data output circuit) stores the image data for displaying an image on the electro-optical panel 400. Specifically, the memory 200 includes a memory cell array that includes a plurality of memory cells, and stores the image data (display data) corresponding to at least one frame (one screen). The memory 200 may also include a row address decoder that decodes a row address and selects a wordline, a column address decoder that decodes a column address and selects a bitline of the memory cell array, a write/read circuit that writes or reads the image data, and the like. When the semiconductor device 90 does not include a memory, the semiconductor device 90 may include a data register that captures and stores image data input in time division, a shift register (bidirectional shift register) that outputs an image data capture signal (i.e., a signal obtained by sequentially shifting an EIO signal) to the data register, a data latch circuit that latches the image data stored in the data register based on a latch pulse, and the like instead of the memory 200.

The control circuit 300 controls the source circuit 100. The control circuit 300 also controls the memory 200. Specifically, the control circuit 300 generates a control signal for controlling a drive timing, a control signal for controlling a display timing, a control signal for controlling a data processing timing, and the like. The control circuit 300 may be formed by an automatic placement and routing process (e.g., gate array (G/A)), for example.

The source circuit 100 includes a plurality of operational amplifiers OP1 to OP25 and the like, a plurality of transmission gates TA1 to TA25, TB1 to TB25, and the like, and a plurality of buffer circuits BF1A to BF12A and BF1B to BF12B.

In FIG. 1, the source circuit 100 is divided into a plurality of source blocks SB1 to SB12. The buffer circuits BF1A to BF 12A and BF1B to BF12B are provided corresponding to the source blocks. The source block SB1 includes the operational amplifiers OP1 to OP25 and the transmission gates TA1 to TA25 and TB1 to TB25. The source block SB1 may also include D/A conversion circuits DAC1 to DAC25. The source blocks SB2 to SB12 have the same configuration as that of the source block SB1. Note that the source circuit 100 may be divided into source blocks of an arbitrary number, and each source block may include operational amplifiers or transmission gates of an arbitrary number. A modification is also possible in which the source circuit 100 is not divided into a plurality of source blocks SB1 to SB12.

The operational amplifiers OP1 to OP25 are circuits that drive the source lines SL1 to SL25. Specifically, the operational amplifiers OP1 to OP25 have a voltage-follower-connected configuration in which the output terminal is connected to the inverting input terminal. The operational amplifiers OP1 to OP25 function as impedance conversion circuits for voltages output from the D/A conversion circuits DAC1 to DAC25. The operational amplifiers OP1 to OP25 are respectively provided corresponding to the source lines SL1 to SL25, for example. Note that a multiplex drive method that drives a plurality of source lines (data lines) using one operational amplifier may also, be employed.

The transmission gates (transfer gates or switch elements) TA1 to TA25 are respectively provided corresponding to the operational amplifiers OP1 to OP25. One end of each transmission gate is connected to the corresponding source line among the source lines SL1 to SL25. The other end of each transmission gate is connected to an input terminal of the corresponding operational amplifier (output terminal of the D/A conversion circuit). For example, the transmission gate TA1 is provided corresponding to the operational amplifier OP1, one end of the transmission gate TA1 being connected to the source line SL1, and the other end of the transmission gate TA1 being connected to the input terminal (non-inverting input terminal) of the operational amplifier OP1. The transmission gates TA2 to TA25 are configured in the same manner as the transmission gate TA1. The transmission gates TA1 to TA25 form a first switch circuit.

The transmission gates TB1 to TB25 are respectively provided corresponding to the operational amplifiers OP1 to OP25. One end of each transmission gate is connected to the corresponding source line among the source lines SL1 to SL25. The other end of each transmission gate is connected to an output terminal of the corresponding operational amplifier. For example, the transmission gate TB1 is provided corresponding to the operational amplifier OP1, one end of the transmission gate TB1 being connected to the source line SL1, and the other end of the transmission gate TB1 being connected to the output terminal of the operational amplifier OP1. The transmission gates TB2 to TB25 are configured in the same manner as the transmission gate TB1. The transmission gates TB1 to TB25 form a second switch circuit.

The D/A conversion circuits DAC1 to DAC25 receive the image data, and D/A-convert the image data. For example, input terminals of the D/A conversion circuits DAC1 to DAC25 are connected to output lines ML1 to ML25 of the memory 200, and D/A-convert the image data read from the memory 200. Specifically, the D/A conversion circuits DAC1 to DAC25 receive a plurality of grayscale voltages (e.g., 64, 128, or 256 grayscale voltages) from the grayscale voltage generation circuit (gamma correction circuit) (not shown), and select a grayscale voltage corresponding to the image data from the plurality of grayscale voltages to D/A-convert the image data. Output terminals of the D/A conversion circuits DAC1 to DAC25 are connected to the non-inverting input terminals of the operational amplifiers OP1 to OP25 and the other ends of the transmission gates TA1 to TA25.

The buffer circuit BFA1 outputs a switch control signal that causes the transmission gates TA1 to TA25 to be turned ON/OFF. Specifically, the buffer circuit BFA1 includes inverters B1, B2, and B3. The buffer circuit BFA1 buffers a control signal CNT from the control circuit 300 using the inverters B1 and B2, and supplies a switch control signal (positive logic) that is a non-inverted signal of the control signal CNT to the gates of N-type MOSFETs (N-type transistors) of the transmission gates TA1 to TA25. The buffer circuit BFA1 also buffers the control signal CNT using the inverter B3, and supplies a switch control signal (negative logic) that is an inverted signal of the control signal CNT to the gates of P-type MOSFETs (P-type transistors) of the transmission gates TA1 to TA25.

The buffer circuit BFB1 outputs a switch control signal that causes the transmission gates TB1 to TB25 to be turned ON/OFF. Specifically, the buffer circuit BFB1 includes inverters B4, B5, and B6. The buffer circuit BFB1 buffers a signal XCNT obtained by causing an inverter B0 to invert the control signal CNT using the inverters B4 and B5, and supplies a switch control signal that is an inverted signal of the control signal CNT to the gates of N-type MOSFETs of the transmission gates TB1 to TB25. The buffer circuit BFB1 also buffers the signal XCNT using the inverter B6, and supplies a switch control signal that is a non-inverted signal of the control signal CNT to the gates of P-type MOSFETs of the transmission gates TB1 to TB25.

An operation according to this embodiment is described below. When the control signal CNT from the control circuit 300 is set at the L level, the N-type and P-type MOSFETs of the transmission gates TB1 to TB25 are turned ON so that the output terminals of the operational amplifiers OP1 to OP25 are electrically connected to the source lines SL1 to SL25 to implement operational amplifier drive. Specifically, the voltages output from the D/A conversion circuits DAC1 to DAC25 are subjected to impedance conversion by the operational amplifiers OP1 to OP25, and then output to the source lines SL1 to SL25. As a result, the voltages of the source lines SL1 to SL25 approach the desired voltages corresponding to the image data.

When the control signal CNT from the control circuit 300 is set at the H level, the N-type and P-type MOSFETs of the transmission gates TA1 to TA25 are turned ON so that the output terminals of the D/A conversion circuits DAC1 to DAC25 are electrically connected to the source lines SL1 to SL25 to implement DAC drive. Specifically, the voltages output from the D/A conversion circuits DAC1 to DAC25 are directly output to the source lines SL1 to SL25 through the transmission gates TA1 to TA25. As a result, the voltage that has approached the desired voltage due to operational amplifier drive can be accurately set at the desired voltage.

The above-described operational amplifier drive and DAC drive are performed once or a plurality of times within one horizontal scan period (1H period). For example, when the transistor (switch element) of the electro-optical panel 400 is formed using a low-temperature polysilicon TFT and multiplex drive is performed, operational amplifier drive and DAC drive are repeated a plurality of times (e.g., three times).

2. Reduction in EMI Noise

A variation in voltage occurs between the source lines SL1 to SL25 during operational amplifier drive due to a variation in offset voltage of the operational amplifiers OP1 to OP25. On the other hand, when performing DAC drive, since the D/A conversion circuits DAC1 to DAC25 have a high output impedance, it takes time until the voltages of the source lines SL1 to SL25 approach the desired voltages corresponding to the image data. In FIG. 1, the voltages of the source lines SL1 to SL25 are brought close to the desired voltages by performing operational amplifier drive, and then accurately set at the desired voltages corresponding to the image data by performing DAC drive.

In this case, the drive time may become insufficient if it takes time to cause the transmission gates to be turned ON/OFF, thereby making it difficult to accurately set the voltages of the source lines SL1 to SL25 at the desired voltages.

Figure 2:
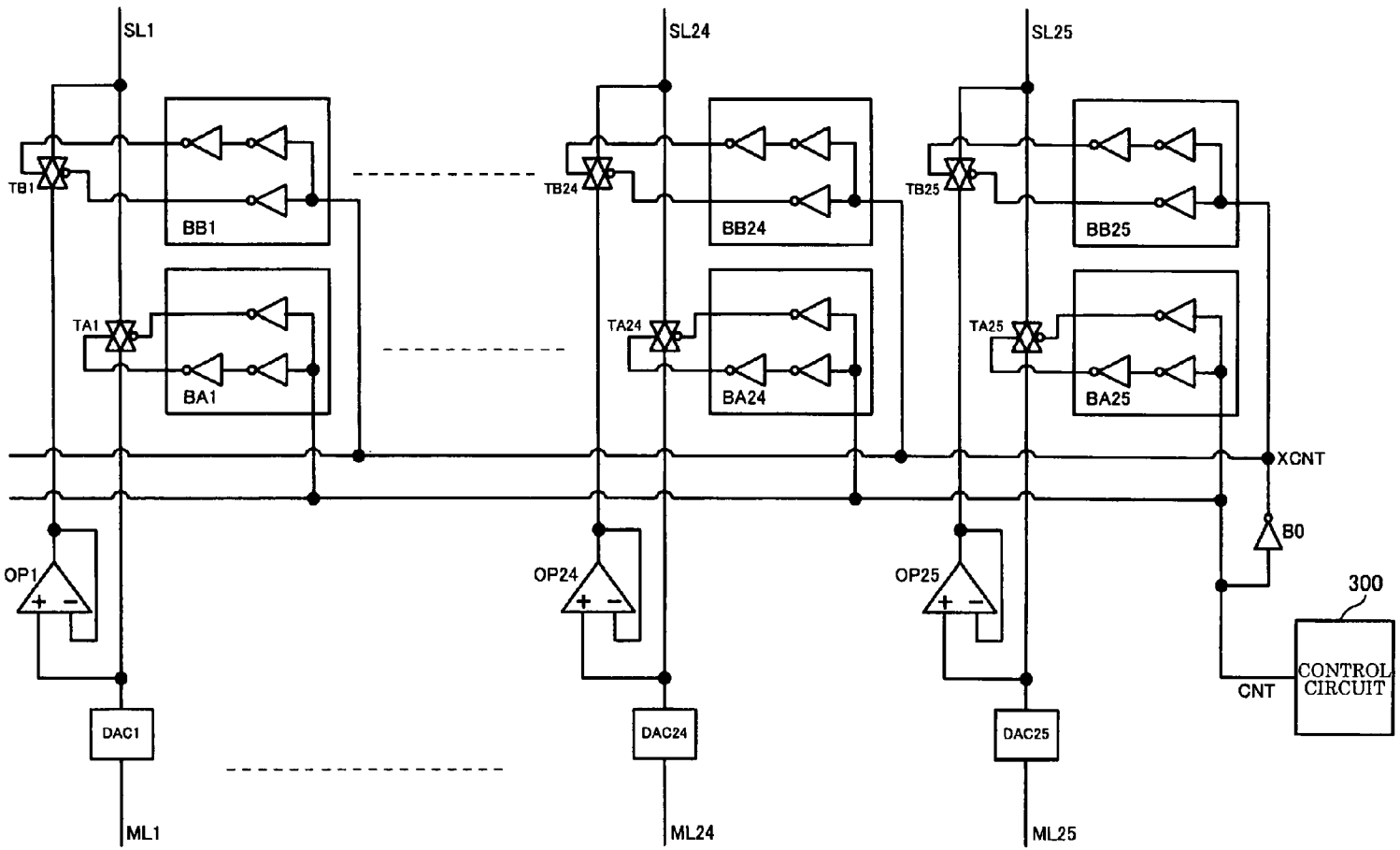
FIG. 2 shows a configuration example according to a comparative example of one embodiment of the invention.

In a comparative example shown in FIG. 2, the buffer circuits are provided corresponding to the transmission gates in order to deal with this problem. Specifically, buffer circuits BA1 to BA25 are provided corresponding to the transmission gates TA1 to TA25, and buffer circuits BB1 to BB25 are provided corresponding to the transmission gates TB1 to TB25. This makes it possible to cause the switch control signals output from the buffer circuits BA1 to BA25 and BB1 to BB25 to rise or fall quickly as compared with FIG. 1.

On the other hand, when causing the switch control signals to rise or fall quickly in order to reduce the drive time, noise generated at the rising edge or the falling edge of the switch control signals contains a large amount of high-frequency components. The noise containing high-frequency components is transmitted to the electro-optical panel 400 through the source lines SL1 to SL25, and EMI noise at a high noise level is radiated to the outside through the electro-optical panel 400 which serves as an antenna.

In the LCD driver, since a large number of transmission gates corresponding to a large number of source lines (300 source lines in FIG. 1) are simultaneously turned ON or OFF, noise at a high level is generated by the source circuit 100. Therefore, EMI noise also has a very high noise level.

For example, when incorporating the semiconductor device according to this embodiment in a portable telephone, the reception sensitivity of the portable telephone decreases due to EMI noise. In particular, EMI noise poses a serious problem when performing multiplex drive or the like in which switching between operational amplifier drive and DAC drive occurs a number of times.

In this embodiment, the buffer circuit is provided corresponding to a plurality of (n) transmission gates, as shown in FIG. 1, differing from FIG. 2 in which the buffer circuit is provided corresponding to one transmission gate. Specifically, a plurality of transmission gates TA1 to TA25 are ON/OFF-controlled using the buffer circuit BF1A. Likewise, a plurality of transmission gates TB1 to TB25 are ON/OFF-controlled using the buffer circuit BF1B. Note that the buffer circuits may be respectively provided corresponding to the transmission gates TB1 to TB25.

According to the method shown in FIG. 1 in which a plurality of transmission gates are turned ON/OFF using the switch control signal output from one buffer circuit, since the total gate capacitance of the MOSFETs of the transmission gates driven using one buffer circuit increases, the waveform of the rising edge or the falling edge of the switch control signal can be rounded. This significantly reduces high-frequency components (e.g., digital noise at 800 to 1400 MHz) of noise generated at the rising edge or the falling edge of the switch control signal, whereby a situation in which such noise is transmitted to the electro-optical panel 400 to generate EMI noise can be prevented. When the waveform of the rising edge or the falling edge of the switch control signal is rounded, the substantial drive time is reduced correspondingly which may adversely affect the display characteristics of the electro-optical panel. However, since the rise time or the fall time of the signal is sufficiently shorter than the overall drive time, the display characteristics of the electro-optical panel 400 are adversely affected to a minimum extent. Therefore, the method in which a plurality of transmission gates are turned ON/OFF using one buffer circuit is employed in FIG. 1.

In order to reduce EMI noise using the method shown in FIG. 1, it is important to optimize the relationship among the number of transmission gates that are turned ON/OFF using the buffer circuit, the gate width and the gate length of the MOSFET of each transmission gate, and the gate width and the gate length of the MOSFET of each buffer circuit.

In this embodiment, when the number of transmission gates that are turned ON/OFF using the buffer circuit is referred to as n, the gate width and the gate length of the MOSFET of the transmission gate are respectively referred to as Wb and Lb, the gate width and the gate length of the MOSFET of the buffer circuit (inverter) are respectively referred to as Wa and La, and K (K>2; e.g., K=10, and preferably K=12) indicates a constant, the relationship $n \times Wb \times Lb \geqq K \times (Wa/La)$ is satisfied. Specifically, the number n of transmission gates that are turned ON/OFF using one buffer circuit is set so that the relationship $n \times Wb \times Lb \geqq K \times (Wa/La)$ is satisfied. EMI noise can be reduced by satisfying such a relationship.

In FIG. 1, n=25 transmission gates (e.g., TA1 to TA25) are ON/OFF-controlled using one buffer circuit (e.g., BF1A), for example. The gate width Wb and the gate length Lb of the P-type MOSFET and the N-type MOSFET of the transmission gate are respectively set at 20.0 μm and 0.6 μm. The gate width Wpa and the gate length Lpa of the P-type MOSFET of the buffer circuit (e.g., inverters B1 and B3) are respectively set at 12.0 μm and 0.6 μm, and the gate width Wna and the gate length Lna of the N-type MOSFET of the buffer circuit are respectively set at 4.0 μm and 0.6 μm. Since the gate width Wpa of the P-type MOSFET is larger than the gate width Wna of the N-type MOSFET in the buffer circuit, the above-mentioned relationship is calculated for the case where the gate width Wa and the gate length La of the MOSFET of the buffer circuit are respectively 12.0 μm and 0.6 μm. In this case, $n \times Wb \times Lb = 25 \times 20.0 \times 0.6 = 300 \geqq K \times (Wa/La) = 12 \times (12.0/0.6) = 240$, thus the relationship is satisfied.

Figure 3:
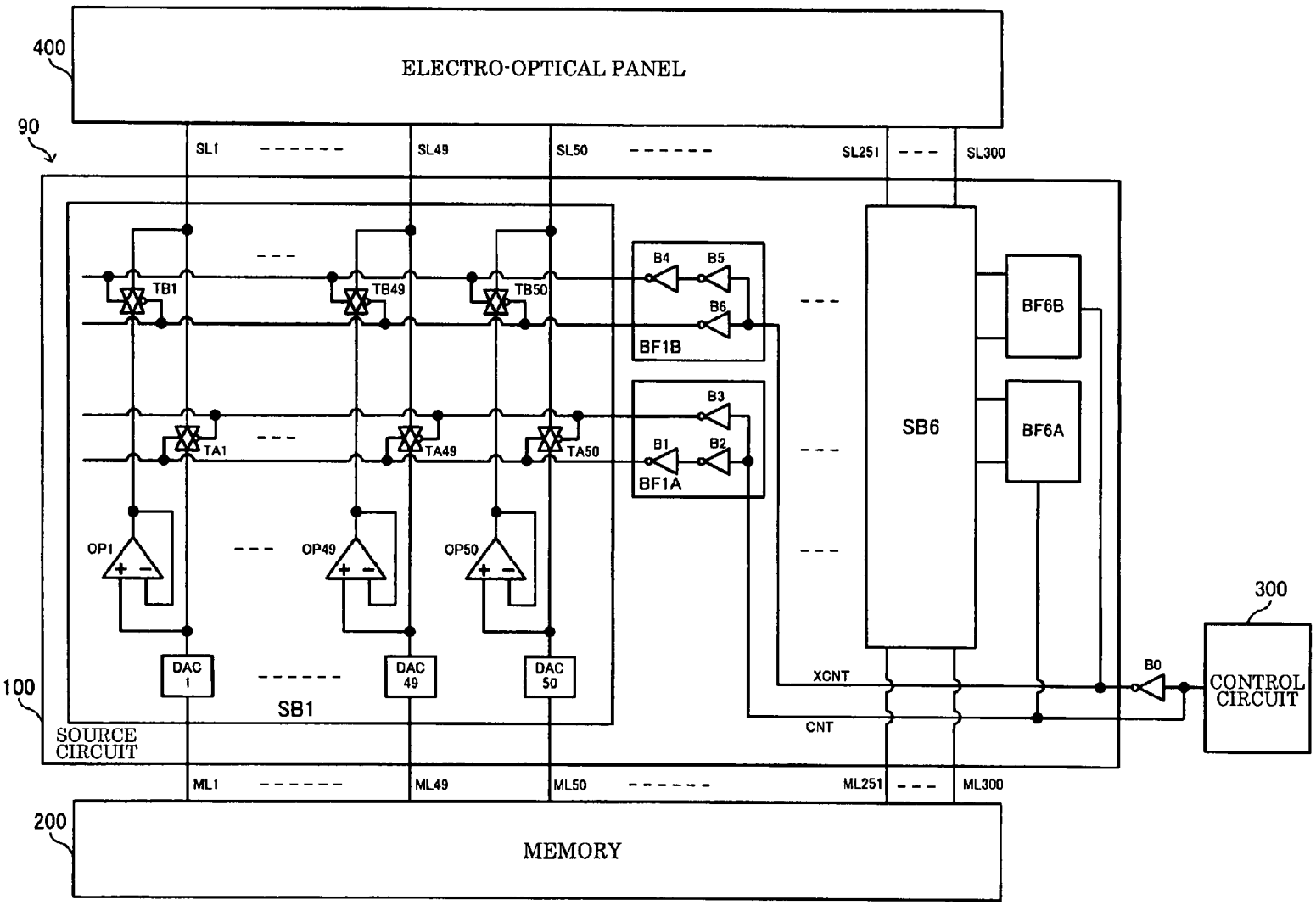
FIG. 3 shows a modification of a semiconductor device according to one embodiment of the invention.

Note that the combination of n, Wa, La, Wb, and Lb is not limited to that shown in FIG. 1. FIG. 3 shows a modification of this embodiment. In FIG. 3, n=50 transmission gates are ON/OFF-controlled using one buffer circuit. The gate width Wb and the gate length Lb of the (P-type and N-type) MOSFET of the transmission gate are respectively set at 10.0 μm and 0.6 μm, and the gate width Wa and the gate length La of the (P-type) MOSFET of the buffer circuit are respectively set at 12.0 μm and 0.6 μm. In this case, $n \times Wb \times Lb = 50 \times 10.0 \times 0.6 = 300 \geqq K \times (Wa/La) = 12 \times (12.0/0.6) = 240$ is satisfied. Therefore, EMI noise can be reduced.

For example, an element parameter pa that indicates the current supply capability of the MOSFET of the buffer circuit is expressed by $\beta a = \mu \times Cox \times (Wa/La)$. μ indicates mobility, and Cox indicates the capacitance of the gate oxide film per unit area. A gate capacitance Cb of the MOSFET of the transmission gate is expressed by $Cb = A \times Wb \times Lb$. Since the gate capacitance varies depending on the gate voltage, the gate capacitance is approximated using the constant A.

When a switching time constant parameter of the transmission gate is referred to as TC, the switching time constant parameter TC is expressed by the following equation (1).

$$TC = (n \times Cb)/\beta a = (n \times A \times Wb \times Lb)/\{\mu \times Cox \times (Wa/La)\} \quad (1)$$

For example, when the electro-optical panel 400 was actually driven using the semiconductor device (LCD driver) according to this embodiment in which Wa=12.0 μm, La=0.6 μm, Wb=20.0 μm, and Lb=0.6 μm, high-frequency (e.g., 800 to 1400 MHz) EMI noise was observed when n=1 (i.e., comparative example shown in FIG. 2). High-frequency EMI noise was also observed when n<20 (e.g., n=8), although the noise level was lower than that when n=1. High-frequency EMI noise was not observed when n≧20 (e.g., n=20 or n=40).

When the switching time constant parameter when n=20, Wa=12.0 μm, La=0.6 μm, Wb=20.0 μm, and Lb=0.6 μm is referred to as TCmin, the switching time constant parameter TCmin is expressed by the following equation (2).

$$\begin{aligned} TC\min &= (n \times A \times Wb \times Lb) / \{\mu \times Cox \times (Wa / La)\} \\ &= (20 \times A \times 20 \times 0.6) / \{\mu \times Cox \times (12 / 0.6)\} \\ &= 12 \times \{A / (\mu \times Cox)\} \end{aligned} \quad (2)$$

Since high-frequency EMI noise was not observed when n≧20, it suffices that the switching time constant parameter TC satisfy TC≧TCmin. Therefore, since (n×A×Wb×Lb)/{μ×Cox×(Wa/La)}≧12×{A/(μ×Cox)} is satisfied from the equations (1) and (2), the terms A, μ, and Cox may be eliminated so that n×Wb×Lb/(Wa/La)≧12 is satisfied. Therefore, n×Wb×Lb≧K×(Wa/La)=12×(Wa/Lb) is satisfied. EMI noise can be prevented by satisfying this relationship, as is clear from the measurement results.

3. First Specific Example

Figure 4:
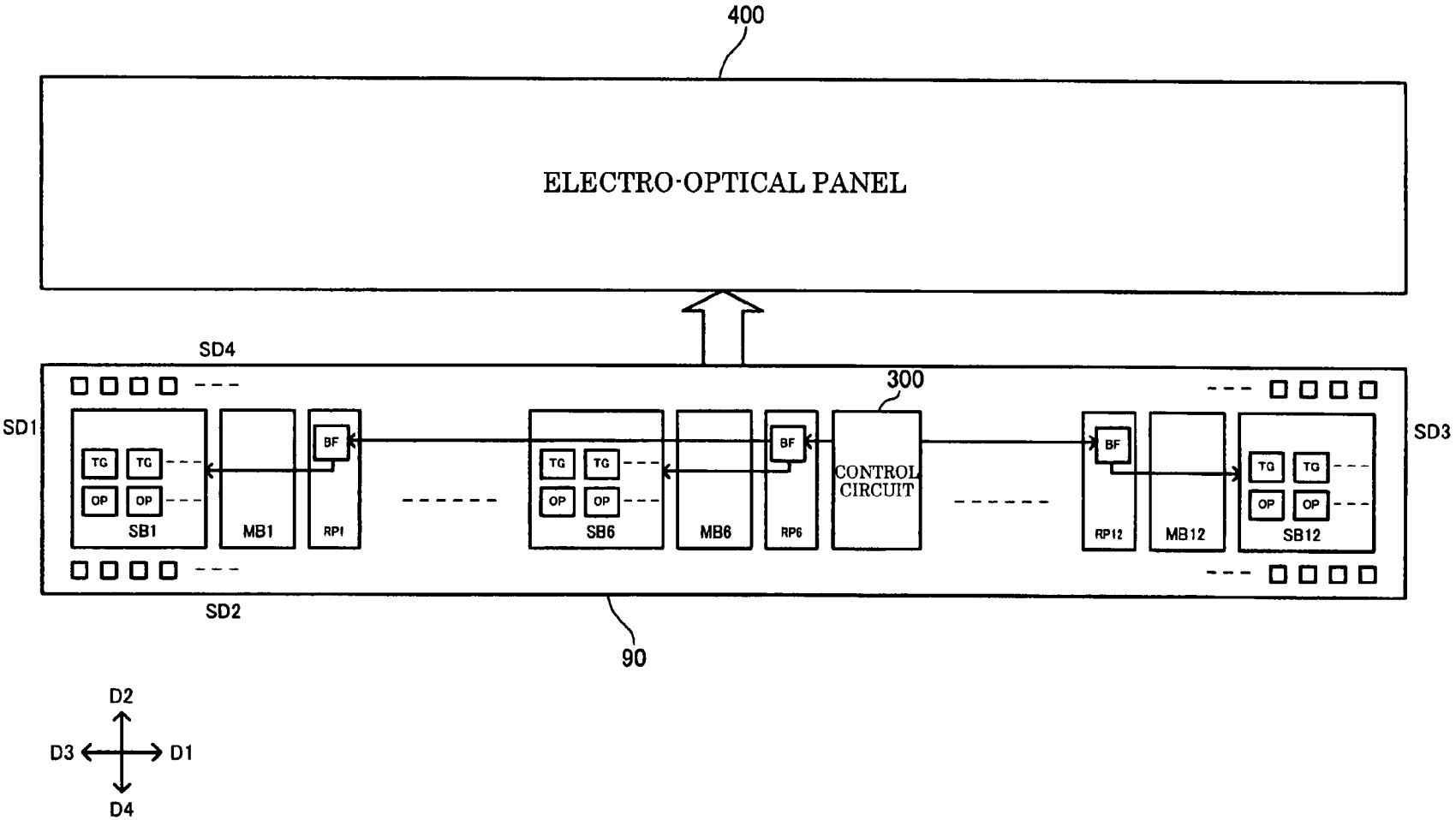
FIG. 4 shows a layout example of a semiconductor device according to a first specific example.

A first specific example according to this embodiment is described below. FIG. 4 shows a specific layout example of the semiconductor device 90 (integrated circuit device) according to the first specific example. In FIG. 4, the direction from a short side SD1 to a short side SD3 (opposite to the short side SD1) of the semiconductor device 90 is referred to as a first direction D1, the direction perpendicular to the first direction (i.e., the direction from a long side SD2 to a long side SD4) is referred to as a second direction D2, the direction opposite to the first direction D1 is referred to as a third direction D3, and the direction opposite to the second direction D2 is referred to as a fourth direction D4.

In FIG. 4, a plurality of source blocks SB1 to SB12 and a plurality of repeater circuits RP1 to RP12 are provided as the source circuit 100 shown in FIG. 1. The memory 200 shown in FIG. 1 is divided into a plurality of memory blocks MB1 to MB12.

The source blocks SB1 to SB 2 and the corresponding memory blocks MB1 to MB12 are respectively disposed (e.g., adjacently) along the direction D1. The source blocks SB1 to SB12 receive image data read from the corresponding memory blocks MB1 to MB12, and drive the corresponding source lines. Specifically, each source block D/A-converts the image data read from the corresponding memory block using the D/A conversion circuit, and outputs the resulting voltage to the source line.

The repeater circuits RP1 to RP12 are respectively provided corresponding to the source blocks SB1 to SB12 (memory blocks). In FIG. 4, the source block SB1, the memory block MB1, and the repeater circuit RP1 are disposed along the direction D1, for example. The source block SB2, the memory block MB2, and the repeater circuit RP2 (not shown) are also disposed along the direction D1. The remaining source blocks, memory blocks, and repeater circuits are disposed similarly. This layout reduces the width of the semiconductor device 90 in the direction D2, whereby a narrow chip can be implemented.

Each of the repeater circuits RP1 to RP12 receives and buffers a signal output from the control circuit 300 disposed around the center of the semiconductor device 90, and outputs the signal to the corresponding source block and memory block, for example. The signal buffered by the repeater circuits RP1 to RP12 may be an image data signal, an address signal, a memory control signal, a display control signal, a driver control signal, a DAC control signal, an operational amplifier control signal, a transmission gate switch control signal, or the like.

For example, the length of the semiconductor device 90 shown in FIG. 4 in the direction D1 (long side direction) is greater than the width in the direction D2 (short side direction). Therefore, if the repeater circuits RP1 to RP12 are not provided, the waveform of the signal output from the control circuit 300 is rounded, whereby a situation in which the signal cannot be appropriately transmitted to each block may occur. A situation in which the signal waveform is rounded can be prevented by providing the repeater circuits RP1 to RP12 shown in FIG. 4 so that a signal transmission error and the like can be prevented.

In FIG. 4, a plurality of operational amplifiers OP and a plurality of transmission gates TG are provided in each of the source blocks SB1 to SB16. The operational amplifiers OP and the transmission gates TG correspond to the operational amplifiers OP1 to OP25 and the transmission gates TA1 to TA25 and TB1 to TB25 shown in FIG. 1.

In FIG. 4, buffer circuits BF are provided in the repeater circuits RP1 to RP12. Each buffer circuit BF provided in the repeater circuits RP1 to RP12 outputs a switch control signal that causes a plurality of transmission gates TG provided in the source blocks SB1 to SB12 to be turned ON/OFF. Specifically, each buffer circuit BF buffers the control signal output from the control circuit 300, and outputs the control signal to the transmission gate TG as the switch control signal.

In this embodiment, the layout of the source blocks SB1 to SB12 and the repeater circuits RP1 to RP12 is determined so that n×Wb×Lb≧K×(Wa/La) is satisfied. Specifically, when the gate width Wb and the gate length Lb of the MOSFET of the transmission gate TG and the gate width Wa and the gate length La of the MOSFET of the buffer circuit BF have been determined, the number n of transmission gates controlled using one buffer circuit BF is determined using the relational expression "n×Wb×Lb≧K×(Wa/La)". The number of source blocks is determined so that the number of transmission gates TG is equal to the number n thus determined. For example, when n=25 (see FIG. 1), the number of source blocks is determined so that the number n of transmission gates TG provided in each source block is 25. In FIG. 4, the source circuit 100 is divided into twelve source blocks SB1 to SB12. Note that the number of source blocks may be determined in advance, and the number n of transmission gates TG may be determined based on the number of source blocks. The gate width Wb and the gate length Lb the transmission gate TG and the gate width Wa and the gate length La of the buffer circuit BF may be determined based on the number n thus determined and the relational expression "n×Wb×Lb≧K×(Wa/La)".

According to the method used in the first specific example, the area of the semiconductor device 90 can be reduced by dividing the source circuit 100 into a plurality of source blocks to optimize the layout while reducing EMI noise by setting the values n, Wb, Lb, Wa, and La to optimum values for the layout. Therefore, the area of the semiconductor device 90 can be reduced while reducing EMI noise.

4. Second Specific Example

Figure 5:
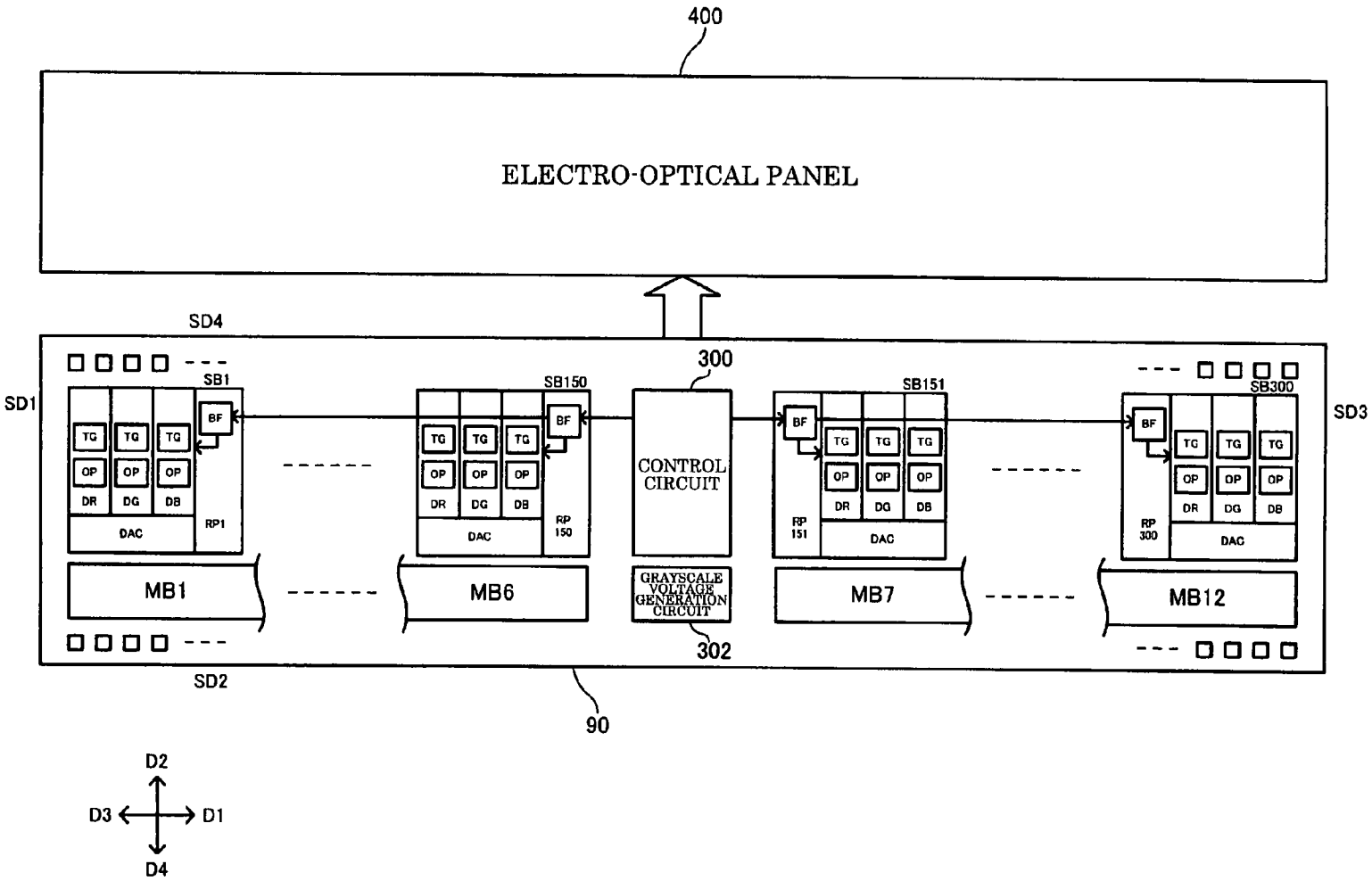
FIG. 5 shows a layout example of a semiconductor device according to a first specific example.

A second specific example according to this embodiment is described below. FIG. 5 shows a specific layout example of the semiconductor device 90 (integrated circuit device) according to the second specific example.

In FIG. 5, a plurality of source blocks SB1 to SB300 and a plurality of repeater circuits RP1 to RP300 are provided as the source circuit 100. A grayscale voltage generation circuit 302 (gamma correction circuit) that generates a plurality of grayscale voltages is also provided. The memory 200 is divided into a plurality of memory blocks MB1 to MB12. Specifically, the source blocks SB1 to SB300 and the memory blocks MB1 to MB12 are adjacently disposed along the direction D2. Each of the memory blocks MB1 to MB12 is shared by twenty-five source blocks, for example.

Each of the source blocks SB1 to SB300 includes three (n=3) source line driver circuits DR, DG, and DB, for example. The source line driver circuits DR, DG, and DB are provided corresponding to R, G, and B subpixels. For example, the source line driver circuits DR, DG, and DB are driver circuits for source lines connected to the R, G, and B subpixels, respectively.

The repeater circuits RP1 to RP300 are respectively provided corresponding to the source blocks SB1 to SB300. Specifically, the repeater circuits RP1 to RP300 and the corresponding source blocks SB1 to SB300 are adjacently disposed along the direction D1.

The operational amplifier OP and the transmission gate TG are provided in each of the three (n=3) source line driver circuits DR, DG, and DB. A buffer circuit BF provided in each of the repeater circuits RP1 to RP300 outputs a switch control signal that causes a plurality of transmission gates TG provided in the source line driver circuits DR, DG, and DB. Specifically, each buffer circuit BF buffers the control signal output from the control circuit 300, and outputs the control signal to the transmission gates TG as the switch control signal.

In FIG. 5, the layout of the source blocks SB1 to SB300 and the repeater circuits RP1 to RP300 is determined so that $n \times Wb \times Lb \geqq K \times (Wa/La)$ is satisfied. In FIG. 5, the number of source blocks is determined so that the number n of transmission gates TG provided in each source block is three. The source circuit 100 is divided into three hundred source blocks SB1 to SB300. Note that the number of source blocks may be determined in advance, and the number n of transmission gates TG may be determined based on the number of source blocks. The gate width Wb and the gate length Lb the transmission gate TG and the gate width Wa and the gate length La of the buffer circuit BF may be determined based on the number n thus determined and the relational expression "$n \times Wb \times Lb \geqq K \times (Wa/La)$".

According to the method used in the second specific example, the area of the semiconductor device 90 can be reduced while reducing EMI noise by setting the values n, Wb, Lb, Wa, and La to optimum values for the layout. Therefore, the area of the semiconductor device 90 can be reduced while reducing EMI noise.

In the second specific example shown in FIG. 5, each of the source blocks SB1 to SB300 includes a D/A conversion circuit DAC. The D/A conversion circuit DAC receives image data from the corresponding memory block, and D/A-converts the image data, for example.

In FIG. 5, the D/A conversion circuit DAC is shared by the three (n=3) source line driver circuits DR, DG, and DB provided in each source block. For example, the source line driver circuits DR, DG, and DB respectively receive output voltages corresponding to R, G, and B subpixels output from the D/A conversion circuit DAC by time division, and drive the corresponding source lines. Specifically, the D/A conversion circuit DAC receives subpixel image data as the image data, and outputs voltages corresponding to the subpixel image data by time division in first to third sampling periods (first to nth sampling periods or first to nth periods in a broad sense). The three (n=3) source line driver circuits DR, DG, and DB sample the voltages output from the D/A conversion circuit DAC in the first to third sampling periods. The source line driver circuits DR, DG, and DB output the sampled voltages to the corresponding source lines. In this case, each of the source line driver circuits DR, DG, and DB may include a sample/hold circuit. More specifically, each of the source line driver circuits DR, DG, and DB may include a flip-around sample/hold circuit.

Figure 6:
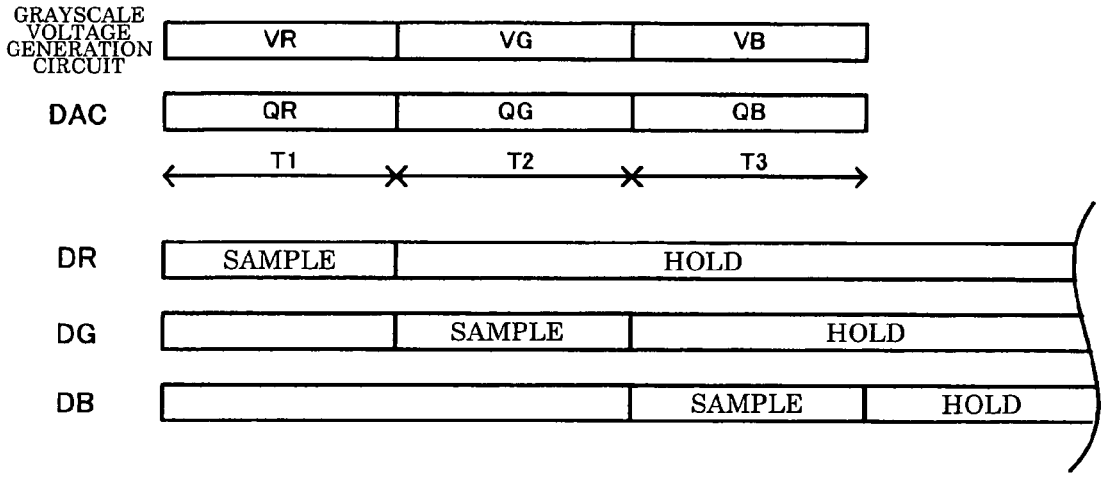
FIG. 6 is a signal waveform example illustrative of an operation according to a second specific example.

FIG. 6 shows a signal waveform example illustrative of an operation according to the second specific example. The grayscale voltage generation circuit 302 shown in FIG. 5 outputs R, G, and B grayscale voltages VR, VG, and VB (e.g., 64, 128, or 256 grayscale voltages) by time division. Specifically, since gamma characteristics differ corresponding to R, G, and B components, the grayscale voltage generation circuit 302 outputs the grayscale voltages VR, VG, and VB (grayscale voltage group) subjected to gamma correction corresponding to the R, G, and B components, respectively.

The D/A conversion circuit DAC receives a plurality of grayscale voltages corresponding to the grayscale voltages VR, VG, and VB and image data, and outputs output voltages QR, QG, and QB corresponding to the image data by time division. For example, the D/A conversion circuit DAC outputs the R output voltage QR in a first sampling period T1, outputs the G output voltage QG in a second sampling period T2, and outputs the B output voltage QB in a third sampling period T3. The R source line driver circuit DR samples and holds the voltage QR output from the D/A conversion circuit DAC in the first sampling period T1. Likewise, the G and B source line driver circuits DG and DB sample and hold the voltages QG and QB output from the D/A conversion circuit DAC in the second and third sampling periods T2 and T3, respectively. The held voltages are output to the source lines in the subsequent 1H period, for example.

In FIG. 1, since the D/A conversion circuits are provided corresponding to the operational amplifiers (source lines), the area occupied by the D/A conversion circuit increases so that the size of the semiconductor device 90 increases, for example. According to the second specific example shown in FIG. 5, the D/A conversion circuit DAC can be shared by providing the source line driver circuits DR, DG, and DB with a sample/hold function. Therefore, the area occupied by the D/A conversion circuit is reduced as compared with FIG. 1 so that the chip size can be reduced.

Figure 7A:
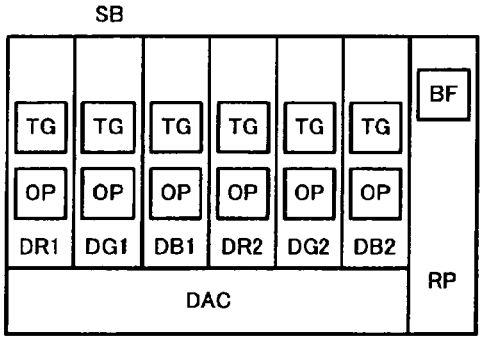
FIGS. 7A and 7B are views illustrative of another configuration example of a source block.

Although FIG. 5 shows an example in which the number n of source line driver circuits included in each source block is three, this embodiment is not limited thereto. In FIG. 7A, the source block SB includes six (n=6) source line driver circuits DR1, DG1, DB1, DR2, DG2, and DB2, for example. The source line driver circuits DR1, DG1, and DB1 drive the source lines corresponding to the R, G, and B subpixels of the first pixel. The source line driver circuits DR2, DG2, and DB2 drive the source lines corresponding to the R, G, and B subpixels of the second pixel adjacent to the first pixel. The operational amplifier OP and the transmission gate TG are provided in each of the source line driver circuits DR1 to DB1 and DR2 to DB2. The buffer circuit BF provided in the repeater circuit RP supplies the switch control signal to these transmission gates TG.

Figure 7B:
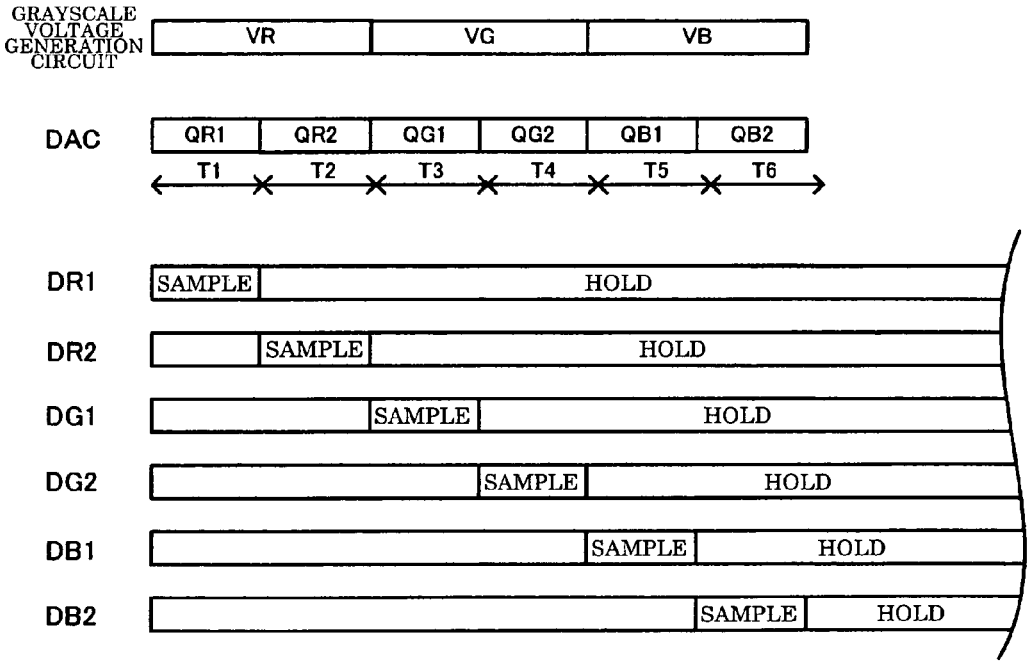

FIG. 7B shows a signal waveform example when employing the configuration shown in FIG. 7A. The grayscale voltage generation circuit 302 outputs the R, G, and B grayscale voltages VR, VG, and VB by time division. The D/A conversion circuit DAC outputs R output voltages QR1 and QR2 in first and second sampling periods T1 and T2, outputs G output voltages QG1 and QG2 in third and fourth sampling periods T3 and T4, and outputs B output voltages QB1 and QB2 in fifth and sixth sampling periods T5 and T6, respectively. The R source line driver circuits DR1 and DR2 respectively sample the voltages QR1 and QR2 output in the first and second sampling periods T1 and T2. The G source line driver circuits DG1 and DG2 respectively sample the voltages QG1 and QG2 output in the third and fourth sampling periods T3 and T4. The B source line driver circuits DB1 and DB2 respectively sample the voltages QB1 and QB2 output in the fifth and sixth sampling periods T5 and T6. Specifically, the number n of source line driver circuits included in one source block SB is arbitrary.

5. Flip-Around Sample/Hold Circuit

The source line driver circuits DR, DG, and DB described with reference to FIG. 5 may be formed using a flip-around sample/hold circuit. The flip-around sample/hold circuit samples a charge corresponding to an input voltage (input signal) using a sampling capacitor in a sampling period, and performs a flip-around operation of the sampling capacitor in a holding period to output a voltage corresponding to the stored charge to an output node, for example.

Figure 8:
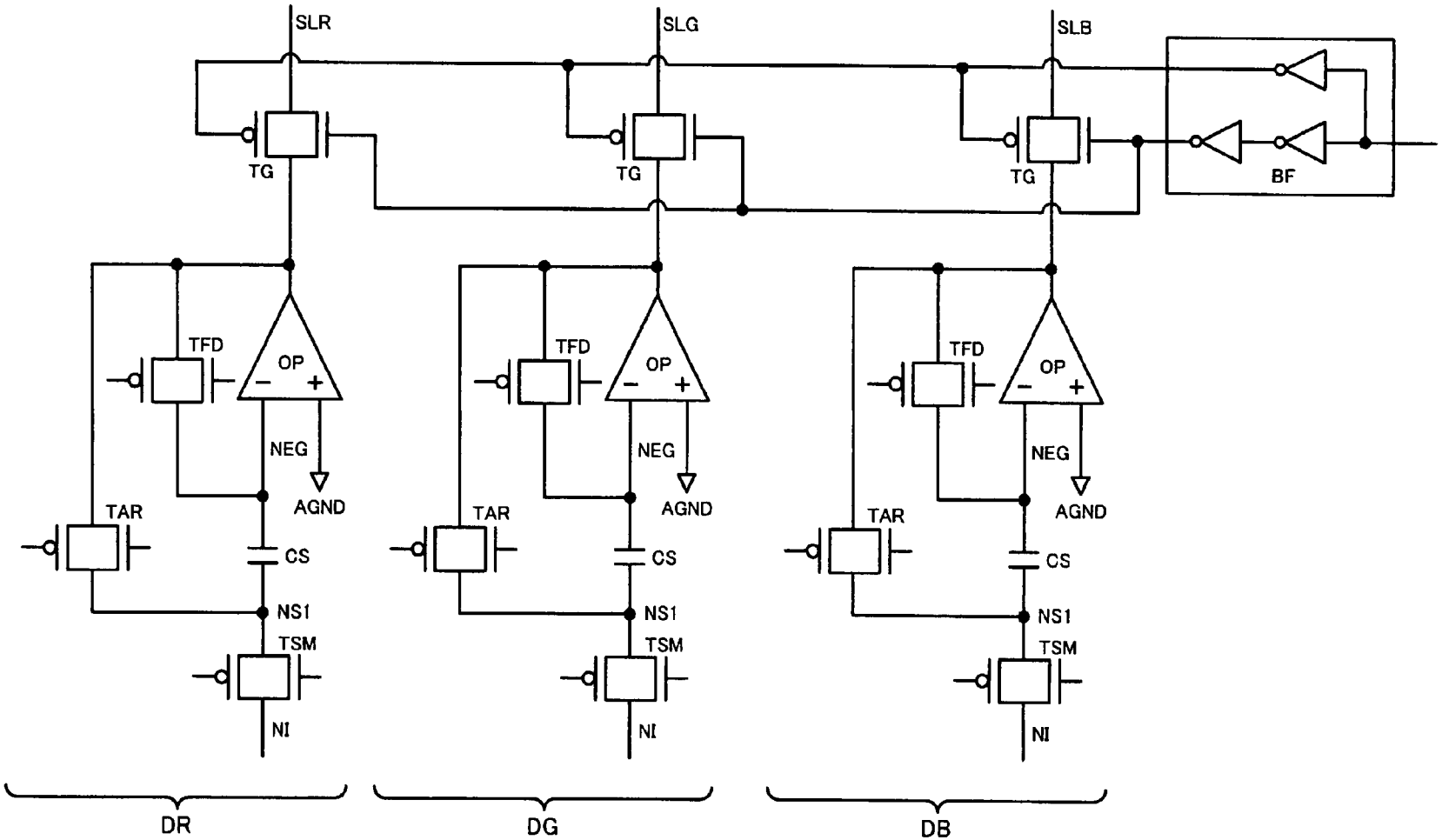
FIG. 8 shows a specific configuration example of a source line driver circuit using a flip-around sample/hold circuit.

FIG. 8 shows a specific configuration example of the source line driver circuits DR, DG, and DB. In FIG. 8, a flip-around sample/hold circuit includes an operational amplifier OP, a feedback transmission gate TFD, a flip-around transmission gate TAR, a sampling transmission gate TSM, and a sampling capacitor CS.

Specifically, a non-inverting input terminal (second input terminal) of the operational amplifier OP is set at a voltage AGND (analog reference power supply voltage). AGND=VDD/2, for example. The feedback transmission gate TFD is provided between an output terminal and an inverting input terminal of the operational amplifier OP. The flip-around transmission gate TAR is provided between the output terminal and a first node NS1 of the operational amplifier OP. The sampling capacitor CS is provided between the inverting input terminal (first input terminal) of the operational amplifier OP and the first node NS1. The sampling transmission gate TSM is provided between an input node NI of the flip-around sample/hold circuit and the first node NS1.

In the sampling period, the sampling transmission gate TSM and the feedback transmission gate TFD are turned ON, and the flip-around transmission gate TAR is turned OFF. In the hold period, the flip-around transmission gate TAR is turned ON, and the sampling transmission gate TSM and the feedback transmission gate TFD are turned OFF.

The operation of the flip-around sample/hold circuit is described in detail below with reference to FIG. 9A.

As shown in FIG. 9A, the output of the operational amplifier OP is fed back to a node NEG of the inverting input terminal of the operational amplifier OP in the sampling period. The voltage AGND is supplied to the non-inverting input terminal of the operational amplifier OP. Therefore, the node NEG connected to one end of the sampling capacitor CS is set at the voltage AGND due to a virtual short circuit function of the operational amplifier OP. Therefore, a charge corresponding to an input voltage VI is stored in the capacitor CS.

As shown in FIG. 9B, an output voltage VQD corresponding to the charge stored in the sampling capacitor CS in the sampling period is output to an output node NQD in the hold period. Specifically, the output voltage VQD corresponding to the charge stored in the CS is output by performing the flip-around operation that connects the other end of the capacitor CS of which one end is connected to the node NEG, to the output terminal of the operational amplifier OP.

An offset-free state can be implemented using the flip-around sample/hold circuit.

For example, an offset voltage generated between the inverting input terminal and the non-inverting input terminal of the operational amplifiers OP is referred to as VOF, the voltage AGND (analog reference power supply voltage) is assumed to be 0 V for convenience of description, the input voltage in the sampling period is referred to as VI, and the capacitance of the capacitor CS is referred to as CS. A charge Q stored in the sampling period is expressed by the following equation.

$$Q=(VI-VOF)\times CS \tag{3}$$

When the voltage of the node NEG in the hold period is referred to as VX and the output voltage is referred to as VQD, a charge Q' stored in the hold period is expressed by the following equation.

$$Q'=(VQD-VX)\times CS \tag{4}$$

When the amplification factor of the operational amplifier OP is referred to as A, the output voltage VQD is expressed by the following equation.

$$VQD=-A\times(VX-VOF) \tag{5}$$

Since Q=Q' is satisfied according to the principle of charge conservation, the following equation is satisfied.

$$(VI-VOF)\times CS=(VQD-VX)\times CS \tag{6}$$

Therefore, the following equation is satisfied from the equations (5) and (6).

$$VQD=VI-VOF+VX=VI-VOF+VOF-VQD/A$$

Therefore, the output voltage VQD of the flip-around sample/hold circuit is expressed by the following equation.

$$VQD=\{1/(1+1/A)\}\times VI \tag{7}$$

As is clear from the equation (7), since the output voltage VQD of the flip-around sample/hold circuit is independent of the offset voltage VOF so that an offset can be canceled, an offset-free state can be implemented. Therefore, a variation in output voltage between the source lines can be minimized by applying the flip-around sample/hold circuit to the source line driver circuit. As a result, highly accurate voltages with a small variation can be supplied to the source lines so that the display quality can be improved. Moreover, since DAC drive that directly drives the source line using the D/A conversion circuit (see FIG. 1) becomes unnecessary, high-speed drive and simplified control can be implemented.

In FIG. 8, one end of the transmission gate TG is connected to a source line SLR, SLG, or SLB, and the other end of the transmission gate TG is connected to the output terminal of the operational amplifier OP of the flip-around sample/hold circuit. The transmission gates TG are ON/OFF-controlled using the buffer circuit BF. Specifically, the transmission gate TG is turned OFF in the sampling period of the flip-around sample/hold circuit, and is turned ON in the hold period of the flip-around sample/hold circuit. A situation in which unstable voltages output from the operational amplifiers OP in the sampling period of the flip-around sample/hold circuit are transmitted to the source lines SLR, SLG, and SLB can be prevented by providing the transmission gates TG.

When the gate width and the gate length of the MOSFET of the transmission gate TG are respectively referred to as Wb and Lb and the gate width and the gate length of the MOSFET of the buffer circuit BF are respectively referred to as Wa and La, $n \times Wb \times Lb = 3 \times Wb \times Lb \geqq K \times (Wa/La)$ is satisfied. Therefore, EMI noise can be reduced. According to the configuration shown in FIG. 8, highly accurate voltages with a small variation can be supplied to the source lines by utilizing the flip-around sample/hold circuit while reducing EMI noise. Therefore, the display quality can be improved while improving EMI noise.

Figure 10:
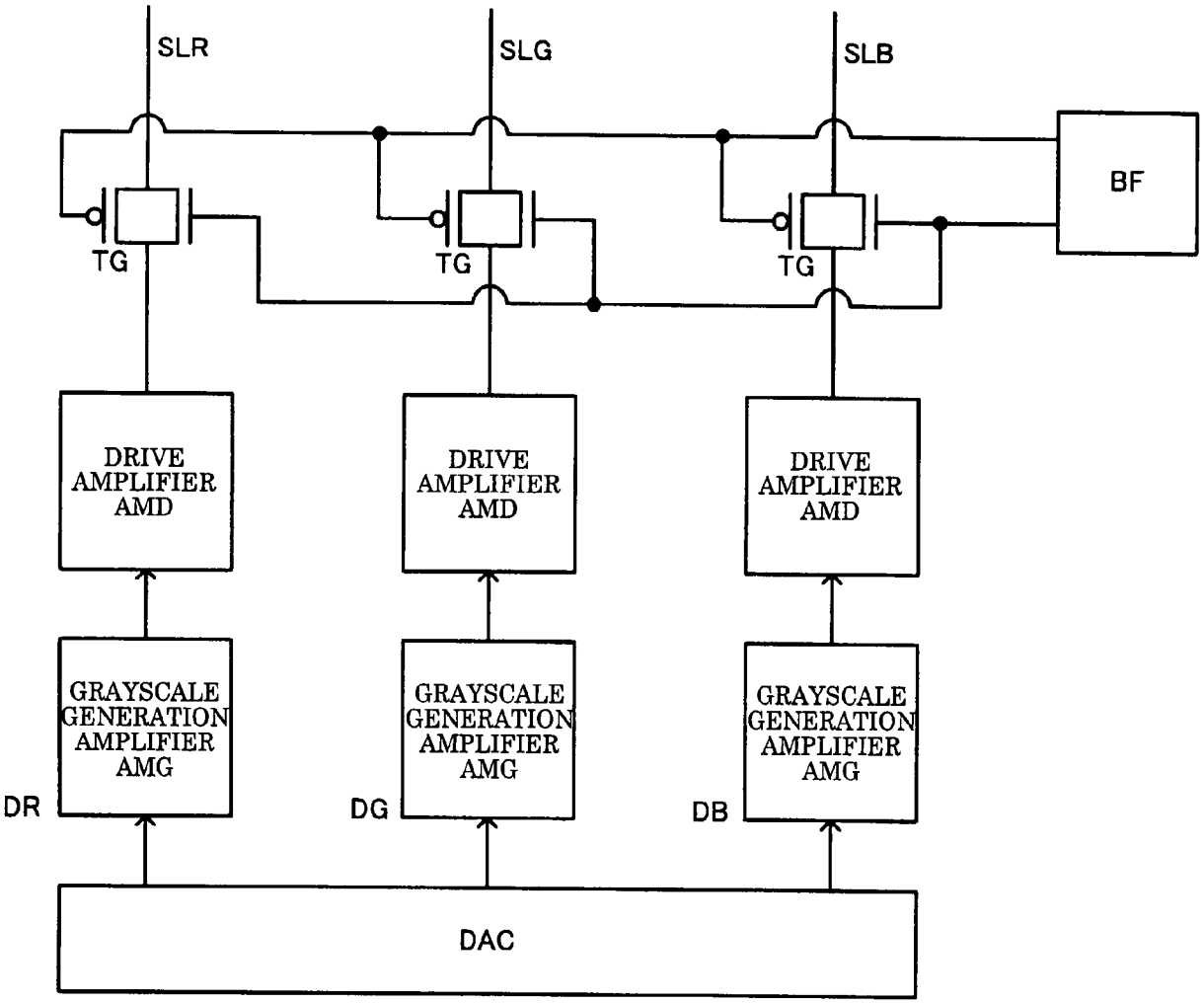
FIG. 10 shows another configuration example of a source line driver circuit.

The configuration of the source line driver circuits DR, DG, and DB is not limited to that shown in FIG. 8. As shown in FIG. 10, a drive amplifier AMD and a grayscale generation amplifier AMG may be provided in each of the source line driver circuits DR, DG, and DB. A flip-around sample/hold circuit having the configuration described with reference to FIG. 8 may be used as the drive amplifier AMD. The grayscale generation amplifier AMG utilizes a flip-around sample/hold circuit having a configuration differing from that shown in FIG. 8. The grayscale generation amplifier AMG generates a grayscale voltage between the adjacent grayscale voltages output from the D/A conversion circuit DAC, and outputs the generated grayscale voltage to the drive amplifier AMD. The drive amplifier AMD samples the voltage output from the grayscale generation amplifier AMG in a hold period of the grayscale generation amplifier AMG. The transmission gates TG are turned ON in the hold period of the drive amplifiers AMD so that the voltages held by the drive amplifiers AMD are output to the source lines SLR, SLG, and SLB. According to the configuration shown in FIG. 10, since the grayscale voltage between the adjacent grayscale voltages can be generated by the grayscale generation amplifier AMG, the number of grayscales necessary for the grayscale voltage generation circuit 302 and the D/A conversion circuit DAC can be reduced so that the circuit scale can be reduced.

An example in which the method according to this embodiment is applied to the transmission gate that switches between operational amplifier drive and DAC drive (see FIG. 1) or the transmission gate for the flip-around sample/hold circuit (see FIG. 8) has been described above. Note that this embodiment is not limited thereto. Various modifications may be made.

Figure 11A:
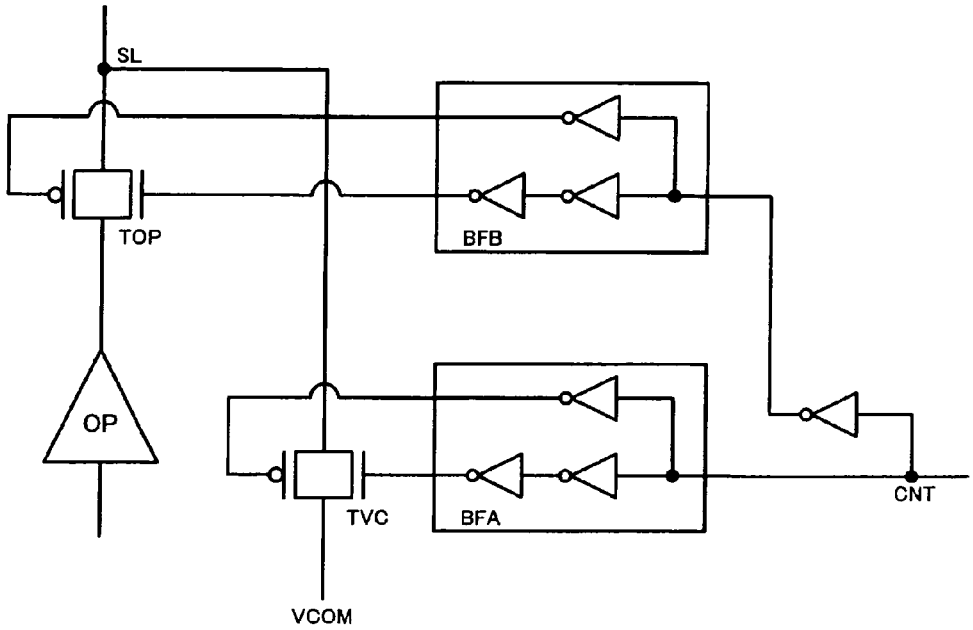
FIGS. 11A and 11B shows another application example of one embodiment of the invention.

In FIG. 11A, one end of a transmission gate TVC is connected to the corresponding source line SL among a plurality of source lines, and a common potential VCOM is supplied to the other end of the transmission gate TVC, for example. One end of a transmission gate TOP is connected to the corresponding source line SL among a plurality of source lines, and the other end of the transmission gate TOP is connected to an output terminal of the operational amplifier OP.

Figure 11B:
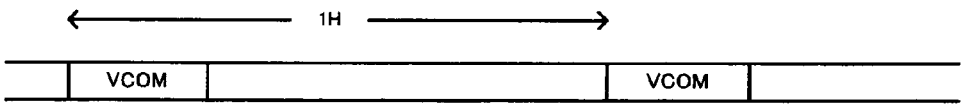

The common potential VCOM is a common potential supplied to a common electrode opposite to a pixel electrode, for example. The transmission gate TVC is turned ON and the transmission gate TOP is turned OFF in the first period of the 1H period (horizontal scan period) so that all of the source lines can be set at the common potential VCOM in the first period, as shown in FIG. 11B. According to this configuration, since the source line of the electro-optical panel 400 is charged or discharged by recycling a charge stored in the electro-optical panel 400, power consumption can be further reduced.

In FIG. 11A, a buffer circuit BFA supplies a switch control signal to the transmission gate TVC, and a buffer circuit BFB supplies a switch control signal to the transmission gate TOP. In this embodiment, the number n of transmission gates TVC and the like that are turned ON/OFF using the buffer circuit BFA and the like, the gate width Wb and the gate length Lb of the transmission gate TVC and the like, and the gate width Wa and the gate length La of the buffer circuit BFA and the like, are set so that $n \times Wb \times Lb \geqq K \times (Wa/La)$ is satisfied. This makes it possible to reduce power consumption by setting the source line at the common potential VCOM every 1H period while reducing EMI noise. Therefore, power consumption can be reduced while reducing EMI noise.

6. Electronic Instrument

Figure 12A:
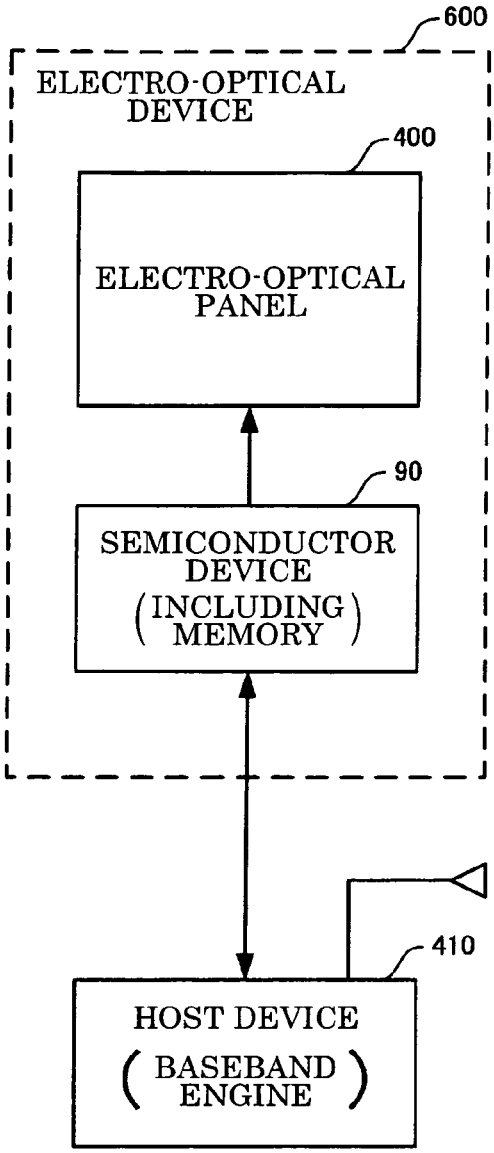
FIGS. 12A and 12B show configuration examples of an electronic instrument.
Figure 12B:
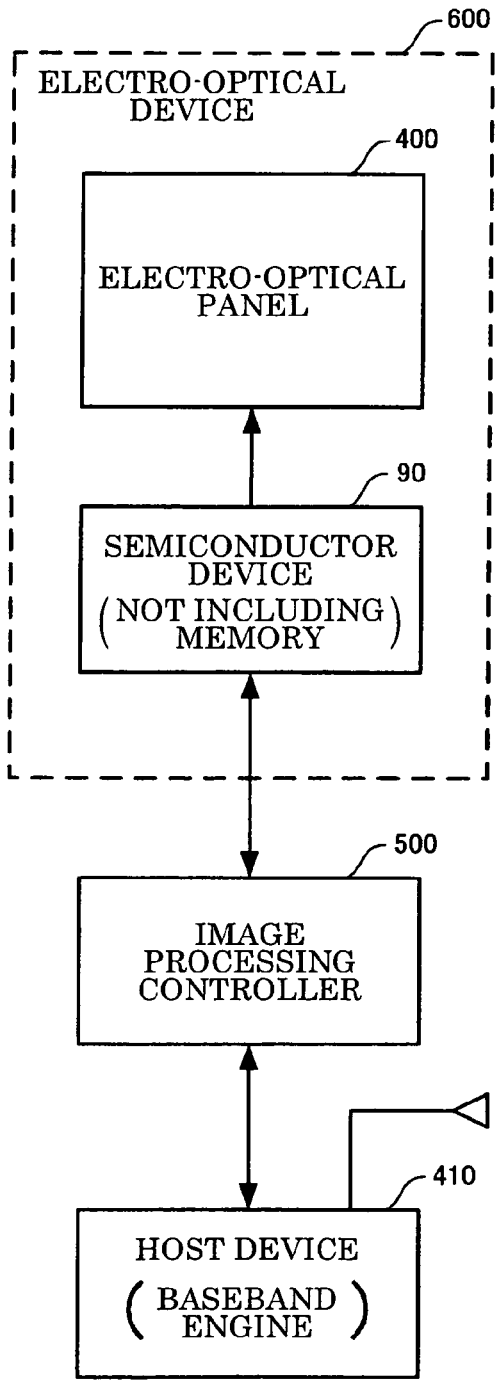

FIGS. 12*a* and 12*b* show configuration examples of an electronic instrument and an electro-optical device 600 including the semiconductor device 90 (driver) according to the above embodiments. Note that various modifications may be made such as omitting some of the elements shown in FIGS. 12A and 12B or adding other elements (e.g., camera, operation section, or power supply). The electronic instrument according to this embodiment is not limited to a portable telephone, but may be a digital camera, a PDA, an electronic notebook, an electronic dictionary, a projector, a rear-projection television, an in-vehicle instrument, a portable information terminal, or the like.

In FIGS. 12A and 12B, a host device 410 is an MPU, a baseband engine, or the like. The host device 410 controls the semiconductor device 90. The host device 410 may also perform a process of an application engine or a baseband engine, or a process (e.g., compression, decompression, or sizing) of a graphic engine. An image processing controller 500 shown in FIG. 12B performs a process (e.g., compression, decompression, or sizing) of a graphic engine instead of the host device 410.

In FIG. 12A, an integrated circuit device including a memory may be used as the semiconductor device 90 (i.e., LCD driver). In this case, the semiconductor device 90 writes image data from the host device 410 into the memory, reads the image data from the memory, and drives an electro-optical panel 400. In FIG. 12B, the semiconductor device 90 may not include a memory. In this case, image data output from the host device 410 is written into a memory included in the image processing controller 500. The semiconductor device 90 drives the electro-optical panel 400 under control of the image processing controller 500.

Although some embodiments of the invention have been described in detail above, those skilled in the art would readily appreciate that many modifications are possible in the embodiments without materially departing from the novel teachings and advantages of the invention. Accordingly, such modifications are intended to be included within the scope of the invention. Any term (e.g., inverting input terminal, non-inverting input terminal, and voltage AGND) cited with a different term (e.g., first input terminal, second input terminal, and analog reference power supply voltage) having a broader meaning or the same meaning at least once in the specification and the drawings can be replaced by the different term in any place in the specification and the drawings. The configurations and the operations of the semiconductor device, the source circuit, the source block, the source line driver circuit, the D/A conversion circuit, the electro-optical device, the electronic instrument, and the like are not limited to those described with reference to the above embodiments. Various modifications and variations may be made.

What is claimed is:

1. A semiconductor device that drives an electro-optical panel, the semiconductor device comprising:

a source circuit that drives a plurality of source lines of the electro-optical panel; and a control circuit that controls the source circuit, the source circuit including:

a plurality of operational amplifiers that respectively drive the plurality of source lines;

a plurality of transmission gates provided corresponding to the plurality of operational amplifiers, one end of each of the plurality of transmission gates being connected to a corresponding source line among the plurality of source lines; and a buffer circuit that outputs a switch control signal that causes the plurality of transmission gates to be turned ON/OFF; and when the number of transmission gates that are turned ON/OFF using the buffer circuit is referred to as n, a gate width and a gate length of a MOSFET of each of the plurality of transmission gates are respectively referred to as Wb and Lb, a gate width and a gate length of a MOSFET of the buffer circuit are respectively referred to as Wa and La, and K indicates a constant, the relationship $n \times Wb \times Lb \geqq K \times (Wa/La)$ being satisfied.

2. The semiconductor device as defined in claim 1, the source circuit including:

a plurality of source blocks; and a plurality of repeater circuits respectively provided corresponding to the plurality of source blocks;

the plurality of operational amplifiers and the plurality of transmission gates being provided in each of the plurality of source blocks;

the buffer circuit being provided in each of the plurality of repeater circuits; and the buffer circuit provided in each of the plurality of repeater circuits outputting the switch control signal that causes the plurality of transmission gates provided in a corresponding source block among the plurality of source blocks to be turned ON/OFF.

3. The semiconductor device as defined in claim 2, each of the plurality of source blocks including n source line driver circuits;

an operational amplifier among the plurality of operational amplifiers and a transmission gate among the plurality of transmission gates being provided in a corresponding source line driver circuit among the n source line driver circuits; and the buffer circuit provided in each of the plurality of repeater circuits outputting the switch control signal that causes the plurality of transmission gates provided in the n source line driver circuits to be turned ON/OFF.

4. The semiconductor device as defined in claim 3, each of the plurality of source blocks including a D/A conversion circuit that receives image data and D/A-converts the image data; and the D/A conversion circuit being shared by the n source line driver circuits.

5. The semiconductor device as defined in claim 4, the D/A conversion circuit receiving subpixel image data as the image data, and outputting voltages corresponding to the subpixel image data by time division in each of first to nth sampling periods; and each of the n source line driver circuits sampling the voltages output from the D/A conversion circuit in each of the first to nth sampling periods.

6. The semiconductor device as defined in claim 3, each of the n source line driver circuits including a flip-around sample/hold circuit that includes an operational amplifier among the plurality of operational amplifiers.

7. The semiconductor device as defined in claim 6, the other end of each of the plurality of transmission gates being connected to an output terminal of the operational amplifier of the corresponding flip-around sample/hold circuit.

8. The semiconductor device as defined in claim 6, the flip-around sample/hold circuit including:

the operational amplifier, a non-inverting input terminal of the operational amplifier being set at an analog reference power supply voltage;

a feedback transmission gate provided between an output terminal and an inverting input terminal of the operational amplifier;

a flip-around transmission gate provided between the output terminal of the operational amplifier and a first node;

a sampling capacitor provided between the inverting input terminal of the operational amplifier and the first node; and a sampling transmission gate provided between an input node of the flip-around sample/hold circuit and the first node.

9. The semiconductor device as defined in claim 1, one end of each of the plurality of transmission gates being connected to a corresponding source line among the plurality of source lines, and the other end of each of the plurality of transmission gates being connected to an input terminal of a corresponding operational amplifier among the plurality of operational amplifiers.

10. The semiconductor device as defined in claim 1, one end of each of the plurality of transmission gates being connected to a corresponding source line among the plurality of source lines, and a common potential being supplied to the other end of each of the plurality of transmission gates.

11. The semiconductor device as defined in claim 1, the relationship $n \times Wb \times Lb \geqq 12 \times (Wa/La)$ being satisfied.

12. An electro-optical device comprising the semiconductor device as defined in claim 1.

13. An electronic instrument comprising the electro-optical device as defined in claim 12.

14. A semiconductor device comprising:

a plurality of transmission gates; and a buffer circuit that outputs a switch control signal that causes the plurality of transmission gates to be turned ON/OFF, when the number of transmission gates that are turned ON/OFF using the buffer circuit is referred to as n, a gate width and a gate length of a MOSFET of each of the plurality of transmission gates are respectively referred to as Wb and Lb, a gate width and a gate length of a MOSFET of the buffer circuit are respectively referred to as Wa and La, and K indicates a constant, the relationship $n \times Wb \times Lb \geqq K \times (Wa/La)$ being satisfied.

15. The semiconductor device as defined in claim 14, the relationship $n \times Wb \times Lb \geqq 12 \times (Wa/La)$ being satisfied.

16. An electro-optical device comprising the semiconductor device as defined in claim 14.

17. An electronic instrument comprising the electro-optical device as defined in claim 16.

* * * * *